United States Patent [19]

Holt et al.

[11] Patent Number: 4,789,362

[45] Date of Patent: Dec. 6, 1988

[54] MARINE PROPULSION DEVICE INCLUDING GAUGE WITH ADJUSTABLE SENSITIVITY

[75] Inventors: James L. Holt, Bristol, Wis.; Jeffrey A. Olson, Waukegan, Ill.

[73] Assignee: Outboard Marine Corporation, Waukegan, Ill.

[21] Appl. No.: 9,082

[22] Filed: Jan. 27, 1987

Related U.S. Application Data

[63] Continuation of Ser. No. 744,479, Jun. 13, 1985, abandoned.

[51] Int. Cl.[4] ..... B63H 5/12

[52] U.S. Cl. ..... 440/2; 440/53; 324/145

[58] Field of Search ..... 440/1, 2, 53, 61; 340/870.25, 870.38, 689, 987, 984, 870.04; 324/146, 145, 144, 151 R, 76, 110, 115, 116

[56] References Cited

U.S. PATENT DOCUMENTS 3,641,965 2/1972 Schmiedel ..... 440/2

OTHER PUBLICATIONS

Copies of photographs for pp. 5 and 6 of Outboard Marine Corporations's Patent Disclosure, File. No. E-1482.

*Primary Examiner*—Joseph F. Peters, Jr.
*Assistant Examiner*—Edwin L. Swinehart
*Attorney, Agent, or Firm*—Michael, Best & Friedirch

[57] ABSTRACT

A marine propulsion device including a gauge including a magnet supported for pivotal movement, a first wire coil adjacent the magnet and adapted to be connected to a power source, a second wire coil magnetically adjacent and in electrical connection with the first coil and adapted to be connected to ground, and a variable resistor in parallel electrical connection with the second coil.

9 Claims, 1 Drawing Sheet

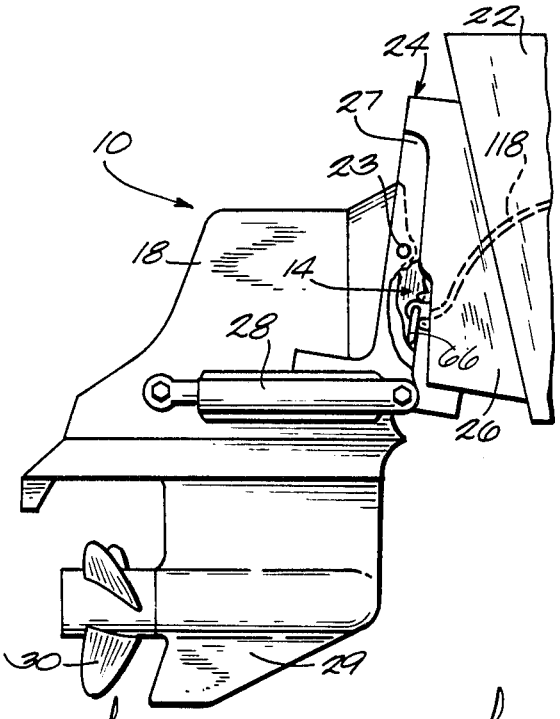
Fig. 1
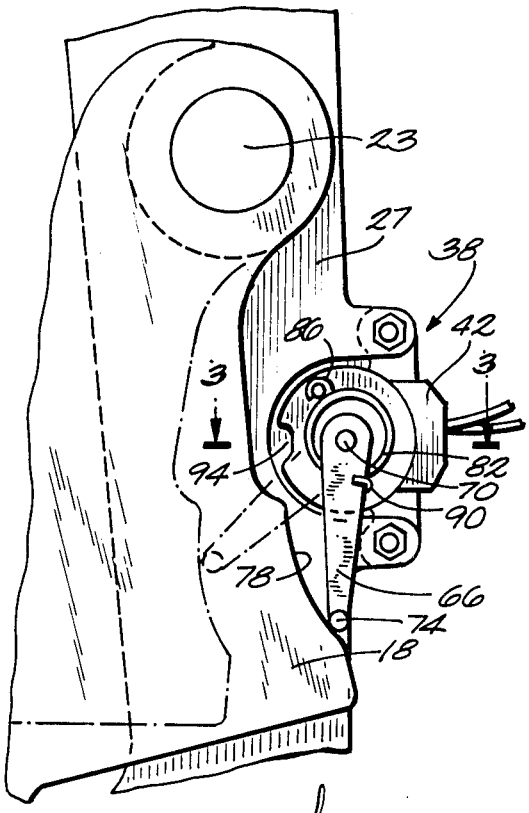
Fig. 2
Fig. 3
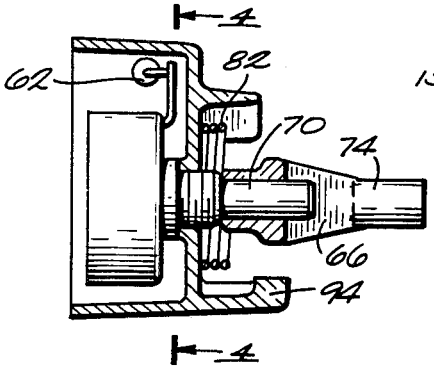
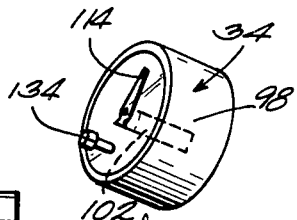
Fig. 6
Fig. 4
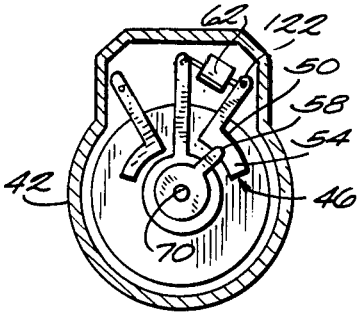
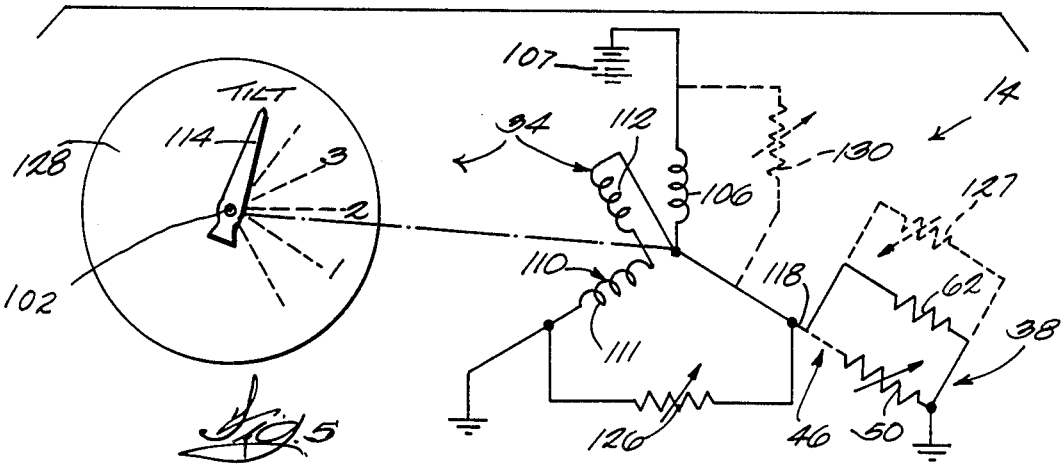
Fig. 5

MARINE PROPULSION DEVICE INCLUDING GAUGE WITH ADJUSTABLE SENSITIVITY

This application is a continuation of application Ser. No. 744,479 filed June 13, 1985, now abandoned.

BACKGROUND OF THE INVENTION

This invention relates to mechanisms provided for indicating the general angular position of a marine propulsion device relative to a boat transom and, more particularly, to trim sending devices and trim gauges.

Attention is directed to the following U.S. Patents:

| Patentee | U.S. Pat. No. | Granted |
|---|---|---|
| W. B. Lurie | 2,681,435 | June 15, 1954 |
| J. R. Baskett | 3,380,011 | April 23, 1968 |
| W. A. Barden | 3,564,476 | February 16, 1971 |
| Kenneth W. Wise | 3,601,082 | August 24, 1971 |
| Robert C. Schmiedel | 3,641,965 | February 15, 1972 |
| Lambrecht, et al. | 3,722,456 | March 27, 1973 |
| Lyle C. Pinkerton | 3,750,617 | August 7, 1973 |
| Carpenter, et al. | 3,797,449 | March 19, 1974 |
| Hager, et al. | 3,834,345 | September 10, 1974 |
| Collis, et al. | 3,844,247 | October 29, 1974 |
| Michael Hentschel | 3,848,185 | November 12, 1974 |
| Drabenko, et al. | 3,886,448 | May 27, 1975 |
| Hager, et al. | 3,894,250 | July 8, 1975 |
| Lambrecht, et al. | 3,929,089 | December 30, 1975 |
| Collis, et al. | 3,931,784 | January 13, 1976 |
| J. A. Davis | 4,005,674 | February 1, 1977 |
| Woodfill, et al. | 4,051,801 | October 4, 1977 |
| Wenstadt, et al. | 4,318,699 | March 9, 1982 |
| Ludwig Lohner | 4,364,733 | December 21, 1982 |
| Donald O. West | 4,420,741 | December 13, 1983 |
| Arthur R. Ferguson | 4,449,945 | May 22, 1984 |
| E. I. Ballard | 4,459,115 | July 10, 1984 |
| Lambrecht, et al. | Re. 28,816 | May 18, 1976 |

SUMMARY OF THE INVENTION

This invention provides a marine propulsion device including a propulsion unit steerable about a generally vertical axis and tiltable about a generally horizontal axis. The propulsion unit includes a lower unit and a propeller rotatably supported by the lower unit, a trim sending device for indicating the general vertical angular position of the propulsion unit, and including a variable resistor adapted to one connected to ground, and a trim gauge comprising a magnet supported for pivotal movement, a first wire coil adjacent the magnet and adapted to be connected to a power source, a second wire coil magnetically adjacent and in electrical connection with the first coil and adapted to be connected to ground, a lead electrically connected between the first coil and the second coil and electrically connected to the trim sending device variable resistor, and means for varying the sensitivity of the gauge to the resistance of the trim sending device variable resistor.

This invention also provides a gauge including a magnet supported for pivotal movement, a first wire coil adjacent the magnet and adapted to be connected to a power source, a second wire coil magnetically adjacent and in electrical connection with the first coil and adapted to be connected to ground, and means for varying the current sensitivity of the gauge.

In one embodiment, the sensitivity varying means comprises a variable resistor in parallel electrical connection with one of the first coil and the second coil.

In one embodiment, the sensitivity varying means comprises a variable resistor in parallel electrical connection with the trim sending device.

One of the principal features of the invention is the provision of a gauge which includes means for varying the current sensitivity of the gauge so that the sensitivity of the gauge can be readily adjusted. This permits the gauge to be individually adjusted to best match the particular trim characteristics of whatever boat it is installed on. For example, the sensitivity varying means permits the gauge to be adjusted in the "field" so that the gauge properly indicates full trim at the ventillation point for the particular motor in its particular installation. Further, the gauge can oe used with different variable resistor sending devices.

Another of the principal features of the invention is the provision of such a gauge which is easily adjustable.

Other features and advantanges of the invention will become apparent upon reviewing the following description, the drawings, and the appended claims.

BRIEF DESCRIPTION OF THE DRAWINGS

FIG. 1 is a schematic side view representation of a marine propulsion device which embodies various of the features of the invention.

FIG. 2 is an enlarged view of a portion of the marine propulsion device including a trim sending device which embodies various of the features of the invention.

FIG. 3 is a cross-sectional view of the trim sending device taken along the line 3—3 in FIG. 2.

FIG. 4 is a cross-sectional view of the trim sending device taken along the line 4—4 in FIG. 3.

FIG. 5 is a schematic representation of a mechanism which is for measuring and visually indicating generally the angular position of the marine propulsion device shown in FIG. 1 and which embodies various of the features of the invention.

FIG. 6 is a perspective view of a trim gauge which embodies various of the features of the invention.

Before an explanation of the invention in detail, it is to be understood that the invention is not limited in its application to the details of the construction and the arrangement of components set forth in the following description or illustrated in the drawings. The invention is capable of other embodiments and of being practiced and carried out in various ways. It is also to be understood that the phraseology and terminology employed herein is for the purpose of description and not of limitation.

DESCRIPTION OF THE PREFERRED EMBODIMENT

Illustrated in the drawings is a marine propulsion device 10 which includes a mechanism 14 for indicating the amount of swinging movement of or angular position of a propulsion unit 18 mounted on a boat transom 22. In the illustrated construction, the marine propulsion unit 18 is in the form of a stern drive and the propulsion unit 18 is mounted on the boat transom 22 by mounting means in the form of a gimbal housing arrangement 24. The gimbal housing arrangement 24 comprises a transom housing 26 connected to the boat transom 22, and a gimbal ring 27 mounted on the transom housing 26 for horizontal swinging movement. The propulsion unit 18 is pivotally connected to the gimbal ring 27 for vertical swinging movement. Accordingly, the gimbal housing arrangement 24 permits swinging of the propulsion unit 18 horizontally about a generally vertical axis for steering, and swinging of the propulsion unit 18 vertically about a generally horizontal pivot axis 23 for trimming and tilting.

Means is also provided in the form of a tilt and trim cylinder assembly 28 connected between the gimbal ring 27 and the propulsion unit 18 for swinging the propulsion unit 18 vertically relative to the boat transom 22.

The propulsion unit 18 also includes a lower unit 29 rotatably supporting a propeller 30, and means (not shown) for rotating the propeller 30.

Although other constructions can be employed in other embodiments, the indicating mechanism 14 (see FIG. 5) provides a visual indication of the general angular position of the propulsion unit 18 relative to the boat transom 22. More particularly, the indicating mechanism 14 shows the general angular position of the propulsion unit 18 as the propulsion unit 18 swings vertically relative to the boat transom 22 through a first angle. The mechanism 14 then indicates the propulsion unit 18 is located at some angular position beyond the first angle. In this particular embodiment, the first angle is a trim angle or range, and movement of the propulsion unit 18 beyond the trim angle is referred to as the tilt angle or range of the propulsion unit 18. Movement of the propulsion unit 18 through the trim range generally provides for raising and lowering of the bow of the boat to change the attitude of the boat while under power, and movement of the propulsion unit 18 through the tilt angle raises the propulsion unit 18 out of the water for service or storage.

The indicating mechanism 14 includes means in the form of a trim gauge 34 (see FIGS. 5 and 6) for producing a general visual indication of the angular position of the propulsion unit 18, and signal sending means in the form of a trim sending device 38 for producing a signal operable to control the trim gauge 34.

More particularly, as illustrated in FIGS. 2 through 5, the trim sending device 38 comprises a housing 42, and a variable resistor 46 (see FIG. 4) including a resistance element 50 supported within the housing 42 and having an end 54, a fixed resistor 62 in parallel electrical connection with the variable resistor 46, and a wiper 58 supported within the housing 42 for pivotal movement along the resistance element 50. Although other constructions can be used in other embodiments, the housing 42 is mounted on the gimbal ring 27 in spaced relation from the generally horizontal pivot axis 23.

The trim sending device 38 also includes moving means adapted to be responsive to the swinging movement of the propulsion unit 18 for moving the wiper 58 along the resistance element 50 as the propulsion unit 18 moves through the trim angle, and for moving the wiper 58 beyond the resistance element end 54 as the propulsion unit 18 moves beyond the predetermined angle. Although other constructions can be used in other embodiments, such moving means comprises a lever 66 (see FIGS. 2 and 3) pivotally mounted on the housing 42. The wiper 58 is connected to the lever 66 for common pivotal movement so that the wiper 58 moves along the resistance element 50 as the lever 66 pivots relative to the trim sending device housing 42. More particularly, as illustrated in FIGS. 3 and 4, a pin 70 pivotally mounts one end of the lever 66 on the housing 42 and connects the lever 66 to the wiper 58.

In other embodiments (not shown), the wiper 58 can be connected at the pivot axis 23 to one of the propulsion unit 18 and the gimbal ring 27, and the resistance element 50 can be mounted on the other of the propulsion unit 18 and the gimbal ring 27. An advantage of having the housing 42 spaced from the pivot axis 23 and of using the lever 66, however, is that a small amount of propulsion unit swing results in a greater amount of swing of the lever 66 and wiper 58, thereby increasing the amount of change in resistance produced by a change in the angle of the propulsion unit 18. As a result, the sending device 38 is more sensitive to propulsion unit movement.

As illustrated in FIG. 2, the moving means also includes means operable between the wiper 58 and the propulsion unit 18 for moving the wiper 58 along the resistance element 50 in an amount which is variably proportional to the amount of swinging movement of the propulsion unit 18. More particularly, the variable proportional moving means comprises a curved camming surface 78 on the propulsion unit 18 adjacent the free end 74 of the lever 66, and means for biasing the free end 74 of the lever 66 into contact with the curved camming surface 78 so that the lever 66 pivots in a manner determined by the curved camming surface 78 as the propulsion unit 18 swings. More particularly, as illustrated in FIGS. 2 and 3, the biasing means is in the form of a torsion spring 82 concentric with the pin 70 and having a first end 86 fixed on the trim sending device housing 42, and a second end 90 which engages the lever 66 to rotate the lever 66 clockwise when viewed as in FIGS. 1 and 2.

The profile of the curved camming surface 78 can be shaped to provide a linear or nonlinear relationship between the amount of wiper movement and vertical movement of the propulsion unit 18, or to alter the multiplication effect on the amount of wiper movement, or to specifically correct for nonlinearites in the indicating mechanism 14 so that the trim gauge indications are directly proportional to the angle of the propulsion unit 18.

Means is also provided for engaging the lever 66 after the lever 66 and wiper 58 swing through the first angle so that the free end 14 of the lever 66 is positioned to be engaged by the curved camming surface 78 when the propulsion unit 18 swings back into the trim range. In the illustrated embodiment, this means is in the form of a stop 94 which is located on the housing 42 and which engages a tab (not shown) on the lever 66 after the lever 66 swings through the trim range.

The operation of the trim sending device 38 is therefore as follows:

As the lever 66 and wiper 58 pivot with the propulsion unit 18 through the trim range, the wiper 58 moves along the length of the resistance element 50. As the wiper 58 moves along the resistance element 50, the resistance of the variable resistor 46 changes in a manner determined by the type of resistance element used. In some constructions, the change in resistance will be a linear function of the amount of wiper movement, and, in other constructions, the change in resistance will be a nonlinear function of the amount of wiper movement.

The amount of movement of the wiper 58 at a particular time is dependent upon the shape of the curved camming surface 78. In other words, the curved camming surface 78 allows for great or small amounts of wiper movement with each amount of propulsion unit swing. The provision of the camming surface 78 therefore permits one to chose a desired relationship between the amount of propulsion unit swing and the resulting change in the resistance of the variable resistor 46. One such desired relationship is to have the change in resistance, when the sending device 38 is connected to the trim gauge 34, produce a change in the visual indication of trim angle which is directly proportional to the actual change in the trim angle of the propulsion unit 18.

By having the variable resistor 46 and the fixed resistor 62 in parallel electrical connection, the following result is achieved. The resistance of the parallel circuit is equal to the inverse of one over the resistance of the variable resistor 46 plus one over the resistance of the fixed resistor 62. The variable resistor 46, when at its lower resistance, has some small value. As the variable resistor's resistance increases, the total resistance of the parallel circuit increases. At the point where the variable resistor's wiper 58 leaves the end 54 of the resistance element 50, the total resistance provided by the parallel circuit changes in a discontinuous manner and increases significantly. As a result, when the parallel circuit is connected across a voltage source, the discontinuous change in the resistance causes a discontinuous change in current passing through the parallel circuit. This change in resistance, when the trim sending device 38 is connected to the trim gauge 34, produces a discontinuous visual indication of the propulsion unit 18 leaving the trim range and entering the tilt range. This visual indication serves to alert an operator of means for swinging the propulsion unit 18 to discontinue swinging the unit 18 unless tilting of the unit 18 is desired.

When the propulsion unit 58 is in the tilt range, the resulting resistance of the parallel circuit is equal to the value of the fixed resistor 62. Since the manufacturing tolerance of a fixed resistor is better than that of a variable resistor, the resistance of the sending device 38 when the propulsion unit 18 is in the tilt range is more predictable. Accordingly, when the propulsion unit 18 is in the tilt range, a more predictable visual indication is obtained.

In other embodiments, the lever 66 can engage a switch (not shown) which is on the housing 42 and which is electrically connected between the fixed resistor 62 and the variable resistor 46 to open the connection therebetween as the propulsion unit 18 travels beyond the predetermined angle. The switch would thus serve to remove the variable resistor 46 from the parallel circuit in a manner similar to the wiper 58 leaving the resistance element 50.

As illustrated in FIGS. 5 and 6, the trim gauge 34 comprises a support in the form of a housing 98, and a magnet 102 supported within the housing 98 for pivotal movement about an end thereof, and a first wire coil 106 adjacent the magnet 102 (as shown schematically in FIG. 5) and in a plane adjacent the magnet 102 and adapted to be connected to a power source, such as the illustrated battery 107. The trim gauge 34 also includes a second wire coil 110 magnetically adjacent and in electrical connection and in the same plane with the first coil 106 and connected to ground. More particularly, the second coil 110 is in the form of a first coil portion 111 connected to ground, and a second coil portion 112 connected to the first coil portion 111 and the first coil 106 and parallel to but extending in the opposite direction to the first coil 106.

The gauge 34 also includes indicator means in the form of a pointer 114 connected in parallel to the magnet 102 to indicate the amount of pivotal movement of the magnet 102. The trim gauge 34 also includes a lead 118 electrically connected between the first coil 106 and the second coil 110 and adapted to be connected to the variable resistor 46 in the trim sending device 38. More particularly, the lead 118 is connected to the terminal 122 of the trim sending device 38. The variable resistor 46 and fixed resistor 62 in the trim sending device 38 are connected to ground.

The face 128 of the trim gauge 34 is also illustrated in FIG. 5. The face 128 includes four triming segments separated by lines numbered one through three, and a tilt segment separated by a fourth line. After the pointer 114 sweeps through the triming segments, thereby indicating the general or approximate angular position of the propulsion unit 18, the pointer 114 jumps across the tilt segment, thereby indicating the propulsion unit 18 is now in the tilt range.

In operation, current passing through the first coil 106 and the second coil 110 produces a magnetic field. Because the first coil 106 and second coil 110 are magnetically adjacent and extends in opposite directions relative to each another, the amount of current passing through one coil as opposed to the other will determine the magnitude and direction of the net magnetic field. The direction of the magnetic field determines the amount of pivotal movement of the magnet 102 because the permanent magnet 102 will always tend to be aligned with the direction of the net magnetic field. As the propulsion unit 18 swings through the trim range, the resistance of the trim sending device 38 changes, thereby changing the amounts of current passing through the coils 106 and 110. This results in a change in the direction of the magnetic field around the magnet 102 and produces a torque applied to the magnet 102. The torque applied to the magnet 102 results in the pivoting of the magnet 102 and movement of the pointer 114 as the magnet 102 and pointer 114 align themselves with the direction of the net magnetic field.

The trim gauge 34 also includes means for varying the current sensitivity of the gauge, i.e., the sensitivity of the guage 34 to the resistance of the trim sending device 38, in the form of a variable resistor 126 in parallel electrical connection with one of the first coil 106 and the second coil 110. More particularly, the variable resistor 126 is in parallel electrical connection with the second coil 110. Alternately, a variable resistor 127 can be connected in parallel electrical connection with the trim sending device 38, as shown by dashed lines in FIG. 5. A calibration resistor in the form of a fixed resistor (not shown) can also be connected in parallel electrical connection with the first coil 106, if desired.

Adjustment of the variable resistor 126 through the coils 106, 111, and 112 results in a change in the relative amounts of current passing through the second coil 110, thereby affecting the resulting position of the pointer 114 produced by the resistance of the trim sending device 38. The effect of the variable resistor 126 on the position of the pointer 114 is greater at greater trim sending device resistances.

Trim gauges, such as guage 34, can be used for various propulsion unit mounting arrangements on various marine vehicles. As a result, the angular position of the particular propulsion unit when the propulsion unit leaves the trim range and enters the tilt range will vary between different installations. The provision of the variable resistor 126 allows a boat operator to adjust the sensitivity of the gauge 34 to the particular boat installation so the trim sending device 38 and trim guage 34 properly indicate the transistion between the trim range and the tilt range.

In an alternate embodiment, as illustrated by dotted lines in FIG. 5, a variable resistor 130 could alternatively be connected in parallel electrical connection with the first coil 106. The variable resistor 130 in this case, however, increases the amount of current sent to the trim sending device 38 and risks overloading the device's power rating. Connection of the variable resistor 126 in parallel with the second coil 110 is, therefore, the preferred embodiment for it sends the current to ground.

As illustrated in FIG. 6, the trim gauge 34 also includes means in the form of a knob 134 for adjusting the resistance of the variable resistor 126. The knob 134 is accessible from outside of the housing 98 so that an operator can easily change the resistance to calibrate the trim gauge 34.

Various of the features of the invention are set fortn in the following claims.

We claim:

1. A marine propulsion device adapted for mounting on a variety of boats having transom angles which vary relative to one another, said marine propulsion device including a propulsion unit adapted to be mounted on the transom a boat so as to be tiltable about a generally horizontal axis and movable through a trim range wherein the angle of the propulsion unit relative to the transom is less than a predetermined angle and through a tilt range wherein the angle of the propulsion unit relative to the transom is greater than the predetermined angle, a trim sending device including a first variable resistance mechanically coupled to said propulsion unit and responsive to movement of said propulsion unit about said horizontal axis and operable to provide a variable electrical effect indicative of the degree of rotation of said propulsion unit about said horizontal axis, a trim gauge responsive to said variable electrical effect and including first and second coils operable to develop a magnetic field having direction and magnitude related to the ratio of currents through said first and second coils, said trim gauge further including a face having thereon marked a trim segment including an end and a tilt segment extending from said end, said trim gauge further including a pointer movable relative to said face response to said variable electrical effect, said marine propulsion device further including adjustable means for locating said pointer substantially at said end of said trim segment when said propulsion unit is substantially at said predetermined angle so as to enable accommodation by the gauge to variation in transom angles and so that said pointer moves from said trim segment to said tilt segment when said propulsion unit moves about said horizontal axis from said trim range to said tilt range, said adjustable means including a second variable resistance connected to vary the ratio of currents through said first and second coils independently of said first variable resistance.

2. A marine propulsion device in accordance with claim 1 wherein said second variable resistance is electrically connected in parallel across said first variable resistance.

3. A marine propulsion device in accordance with claim 1 wherein said second variable resistance is electrically connected in parallel across the other of said first and second coils.

4. A marine propulsion device in accordance with claim 1 wherein said second variable resistance is in parallel electrical connection with said one of said first and second coils.

5. A trim indicating system for use in conjunction with a marine propulsion device adapted for mounting on a variety of boats having transom angles which very relative to one another, which marine propulsion unit includes a propulsion unit adapted to be mounted on a boat transom for tilting movement about a generally horizontal axis and movable through a trim range wherein the angle of the propulsion unit relative to the transom is less than a predetermined angle and through a tilt range wherein the angle of the propulsion unit relative to the transom is greater than the predetermined angle, said trim indicating system comprising a trim sending device including a first variable resistance mechanically coupled to said propulsion unit and responsive to movement of the propulsion unit about the horizontal axis for providing a varying electrical effect indicative of the degree of rotation of the propulsion unit about the horizontal axis, a trim gauge responsive to said varying electrical effect and including first and second coils operable to develop a magnetic field having direction and magnitude related to the ratio of currents through said first and second coils, said trim gauge further including a face having thereon marked a trim segment including to end and a tilt segment extending from said end, and said trim gauge further including a pointer movable relative to said face in response to said variable electrical effect, said trim indicating system further including adjustable means for locating said pointer substantially to said end of said trim segment when the propulsion unit is substantially at the predetermined angle so as to enable accommodation by the gauge to variation in transom angles and so that said pointer moves from said trim segment to said tilt segment when the propulsion unit moves about the horizontal axis from said trim range through said predetermined angle to said tilt range, said adjustable means including a second variable resistance connected to vary the ratio of currents through said first and second coils independently of said first variable resistance.

6. A trim indicating system in accordance with claim 5 wherein said second variable resistance is electrically connected in parallel across said first variable resistance.

7. A trim indicating system in accordance with claim 5 wherein said second variable resistance is electrically connected in parallel across the other of said first and second coils.

8. A trim indicating system in accordance with claim 5 wherein said second variable resistance is in parallel electrical connection with said one of said first and second coils.

9. A trim indicating system for use in conjunction with a marine propulsion device adapted for mounting on a variety of boats having transom angles which vary relative to one another, which marine propulsion unit includes a propulsion unit adapted to be mounted on a boat transom for tilting movement about a generally horizontal axis and movable through a trim range wherein the angle of the propulsion unit relative to the transom is less than a predetermined angle and through a tilt range wherein the angle of the propulsion unit relative to the transom is greater than the predetermined angle, said trim indicating system comprising a trim sending device including a first variable resistance mechanically coupled to said propulsion unit and responsive to movement of the propulsion unit about the horizontal axis for providing a varying electrical effect indicative of the degree of rotation of the propulsion unit about the horizontal axis, a trim gauge responsive to said varying electrical effect and including a face having thereon marked a trim segment including an end and a tilt segment extending from said end, and said trim gauge further including a pointer movable relative to said face in response to said variable electrical effect, said trim indicating system further including adjustable means for locating said pointer substantially to said end of said trim segment when the propulsion unit is substantially at the predetermined angle so as to enable accommodation of the gauge to variation in transom angles and so that said pointer moves from said trim segment to said tilt segment when the propulsion unit moves about the horizontal axis from said trim range through said predetermined angle to said tilt range, said adjustible means including a second variable resistance connected to vary the ratio of currents through said first and second coils independently of said first variable resistance and being in parallel electrical connection with said first variable resistance.

* * * * *